United States Patent [19]

Ohno

[11] Patent Number: 4,676,627

[45] Date of Patent: Jun. 30, 1987

[54] IMAGE FORMING APPARATUS

[75] Inventor: Akio Ohno, Kawaguchi, Japan

[73] Assignee: Canon Kabushiki Kaisha, Tokyo, Japan

[21] Appl. No.: 558,006

[22] Filed: Dec. 5, 1983

[30] Foreign Application Priority Data

Dec. 9, 1982 [JP] Japan ..... 57-215959

[51] Int. Cl.[4] ..... G03G 21/00

[52] U.S. Cl. ..... 355/14 CH; 355/3 CH; 355/3 TR

[58] Field of Search ..... 355/14 SH, 3 SH, 3, 355/3 R, 3 DD, 14 D, 3 CH, 14 CH; 361/212, 229, 220, 235, 213

[56] References Cited

U.S. PATENT DOCUMENTS 3,349,221 10/1967 Schulze et al. ..... 355/3 R
3,357,400 12/1967 Manghirmalani .
3,575,502 4/1981 Eppe .
4,072,412 2/1978 Suda .
4,087,170 9/1978 Sawaoka et al. ..... 355/3 CH
4,134,147 1/1979 Watanabe ..... 355/3 CH
4,314,755 2/1982 Kinashi ..... 355/14 D

*Primary Examiner*—Arthur T. Grimley
*Assistant Examiner*—David Warren
*Attorney, Agent, or Firm*—Fitzpatrick, Cella, Harper & Scinto

[57] ABSTRACT

An image forming apparatus is of such a type that a developed image on an image bearing member is transferred to a transfer sheet and thereafter the transfer sheet is subjected to the action of a charge removing corona discharger, the above apparatus being characterized by a humidity detector, the output of which is used for controlling the output of the charge removing corona discharger, thereby obtaining a proper charge removing function.

7 Claims, 6 Drawing Figures

IMAGE FORMING APPARATUS

BACKGROUND OF THE INVENTION

1. Field of the Invention

The present invention relates to an image forming apparatus in which a latent image can be developed with the toner and transferred to a transfer sheet and wherein the transfer sheet having the transferred image thereon can properly be charge-removed or discharged under the action of charge removing means.

2. Description of the Prior Art

The prior art will be described in connection with an electrophotographic type color copying machine in which a toner image formed on a photosensitive image bearing member can be multi-transferred to the same transfer material or sheet by winding the transfer sheet around a transfer drum (transfer-sheet carrying member) arranged opposed to the photosensitive image bearing member and constituted of a dielectric mesh screen and by rotating the above transfer drum through predetermined number of revolutions. The transfer sheet is held around and is in intimate contact with the outer periphery of the transfer drum under the electrostatic attraction between the screen of the transfer drum, in addition to the leading edge of the transfer sheet being grasped by gripper means mounted on the transfer drum. After completion of the desired number of transfer steps, the transfer sheet will have to be separated from the transfer drum. However, the transfer sheet is charge-removed by means of a charge-removing device to relieve the electrostatic attraction when the leading edge of the transfer sheet is released from the grasp of the gripper. Such a charge removing step may be carried out upon each completion of the transfer steps for the purpose that the efficiency of transfer is prevented from decreasing during the multi-transfer process.

The charge removing function may undesirably decrease the electrostatic attraction of the transferred and non-fixed toner image on the transfer sheet so that the particles of the non-fixed toner will be scattered or that the transfer sheet will be deviated from a predetermined position on the transfer drum to reduce the resulting image in quality.

In the prior art electrophotographic type monochromatic copying machines, a toner image formed on a photosensitive drum is transferred to a transfer sheet fed in contact with the photosensitive drum, under the action of a transfer corona discharger at the transfer station. The transfer sheet is then separated from the photosensitive drum by subjecting the transfer sheet to the action of charge removing means to neutralize the electrostatic attraction between the photosensitive drum and the transfer sheet. Similarly, the charge removing action must suitably be controlled to avoid the above mentioned disadvantages.

It is, however, difficult to suitably control the charge removing action due to the influence of humidity in the prior art image forming systems including electrophotographic type copying machines.

The situation is the same as with image forming devices other than electrophotographic devices, if the similar charge removal after the image transfer is needed.

SUMMARY OF THE INVENTION

It is an object of the present invention to provide an image forming apparatus substantially free from the above disadvantages in the prior art.

Another object of the present invention is to provide an image forming apparatus which can properly be charged-removed by charge removing means such as charge removing corona dischargers or the like under the variations of humidity to obtain a clear image.

These and other objects, features and advantages of the present invention will become more apparent upon a consideration of the following description of the preferred embodiment of the present invention taken in conjunction with the accompanying drawings.

These objects can be accomplished in the preferred embodiment of the present invention by providing an image forming apparatus in which a developed image formed on an image bearing member is transferred to a transfer sheet and thereafter the transfer sheet is subjected to the action of charge removing means, characterized by humidity detection means and means for controlling the output of the charge removing means in accordance with the output of the humidity detection means.

The humidity detection means may be of such a type that the humidity in the atmosphere around the transfer sheet is detected or may be of such a type that the humidity or moisture contact in the transfer sheet itself is detected.

In accordance with the present invention, the transfer sheet can properly be subjected to the charge removing action at all times under the variations of the atmospheric humidity or the moisture content in the transfer sheet such that the scattering of the toner particles and the deviation of the transfer sheet will be prevented to increase image quality.

The following description will be made mainly in connection with an electrophotographic type copying machine for the sake of simplicity. However, the present invention is not limited to such an electrophotographic type copying machine and can similarly be applied to electrostatic printing systems of such a type that an electrostatic latent image is formed on a dielectric member by the use of pin type electrodes or the like, and then developed to form an image which is in turn transferred to a transfer material, magnetic printing systems in which a magnetic latent image is developed by the use of magnetic toner with the resulting developed image being electrostatically transferred to a transfer sheet, and so on.

DESCRIPTION OF THE PREFERRED EMBODIMENTS

Figure 1:
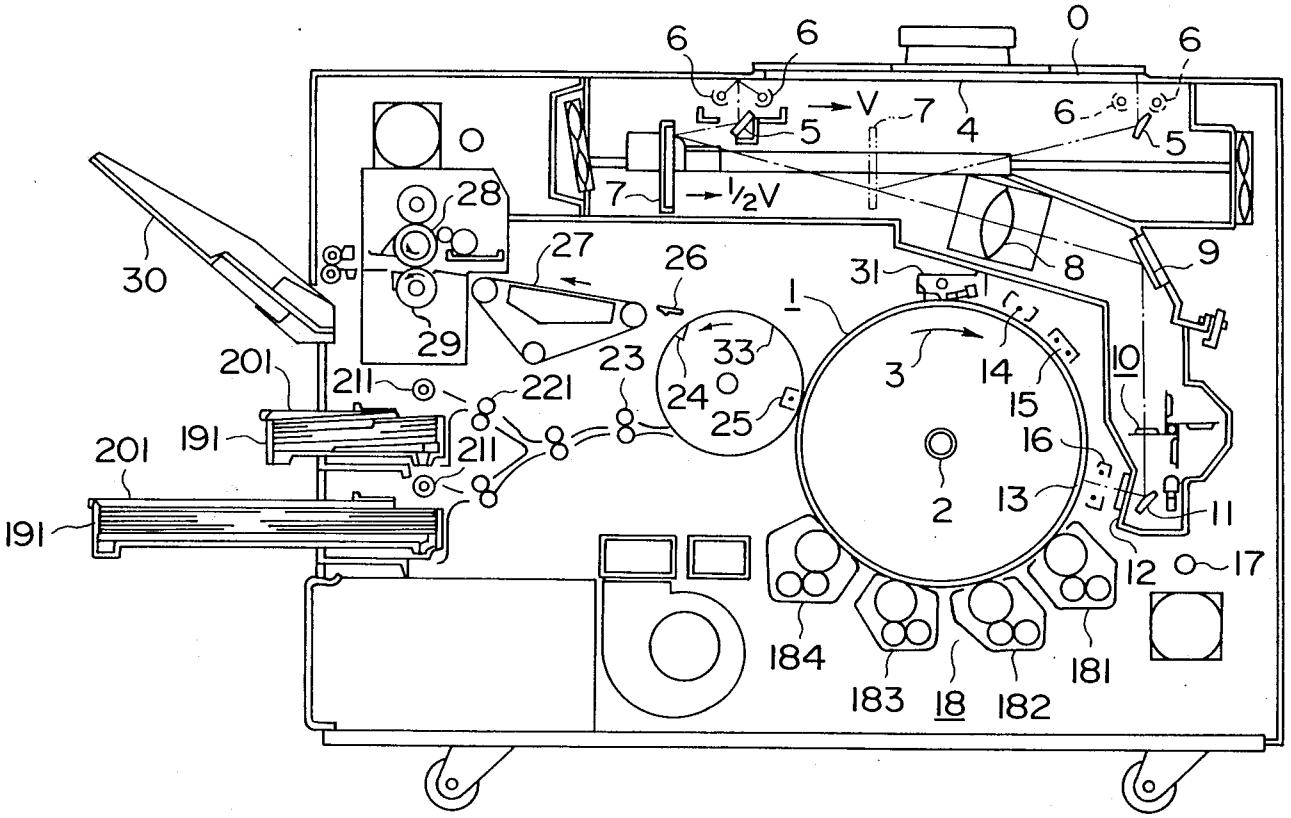
FIG. 1 is a schematic cross-section of an electrophotographic type color copying machine in which the present invention is embodied.

Referring to FIG. 1, an electrophotographic type color copying machine shown herein comprises an electrophotographic type photosensitive drum 1 having a insulative surface layer, the drum 1 being rotatably supported by a shaft 2. In response to a copy instruction, the drum 2 begins to rotate in the direction shown by an arrow 3. When the drum 1 is rotated to a predetermined position, an original O placed on an original table 4 of glass is scanningly illuminated by an illumination lamp 6 integrally mounted with the first movable scanning mirror 5. The light reflected by the original O is received by the second scanning mirror 7 which is similarly movable. The first and second scanning mirror 5 and 7 are moved at the relative speed of 1:1/2 so that the optical path length between the original O and a lens 8 will be maintained constant. The reflected light passes through the lens 8 and the third mirror 9 and then is color separated by color separation filters 10. Thereafter, the light is imaged on the drum 1 through the fourth mirror 11 and a dust-proof sealing glass 12 at an exposure station 13.

The drum 1 is preliminarily charge-removed by a charge removing device 14 and then charged by a primary charger 15, for example, to the positive polarity. The drum 1 is then slit-exposed to the image of the original O irradiated by the illumination lamp 6. At the same time, the drum 1 is charge-removed by a charge removing device 16 of AC or having its polarity component opposite to the primary charge. Subsequently, the drum 1 is subjected to the whole surface exposure from an whole exposure lamp 17 to form an electrostatic latent image of high contrast on the drum 1.

The electrostatic latent image on the photosensitive drum 1 is visualized into a toner image by means of a development assembly 18 which includes four development devices, a yellow development device 181, a magenta development device 182, a cyan development device 183 and a black development device 184. One of these development devices may be used to provide a toner image having the desired color, depending on the one of color separation filters 10 which has been used on the image exposure.

A transfer sheet 201 is fed from a cassette 191 to the copying machine by means of a feed roller 211, adjusted to a rough feed timing at the first register rollers 221 and regulated to a precise feed timing at the second register rollers 23. Thus, the leading edge of the transfer sheet 201 is properly grasped by grippers 24 mounted on a transfer drum 33 as described in detail hereinafter. As the transfer drum 33 is rotated in the direction of the arrow, the transfer sheet 201 is wound around the transfer drum 33 and moved between the photosensitive drum 1 and a transfer charger 25 at the same speed as the peripheral speed of the photosensitive drum 1. During the movement of the transfer sheet 201 between the drum 1 and the transfer charger 25, the toner image on the drum 1 is transferred to the transfer sheet under the action of the corona discharge of the transfer charger 25. The transfer drum 33 is continuously rotated through a predetermined number of revolutions to multi-transfer the images having the desired number of colors to the same transfer sheet while grasping the leading edge of the transfer sheet 201.

In the illustrated copying machine, two cassettes 191 containing transfer sheets different from each other in size or others are mounted therein to feed transfer sheets of the desired size or material in accordance with the applications.

After completion of the multi-transfer process, the transfer sheet is released from the grippers 24 and guided onto a conveyor belt 27 by means of a separation pawl 26. Subsequently, the transfer sheet is introduced into the nip between a pair of fixing rollers 28 and 29 whereat the image is fixed onto the transfer sheet under the action of pressure and heat. Finally, the transfer sheet is discharged to a tray 30.

After completion of the multi-transfer process, the photosensitive drum 1 is cleaned at its surface by a cleaner 31 including a resilient blade contacting the surface of the drum 1. Thereafter, the drum 1 is rotated for the next cycle.

Figure 2:
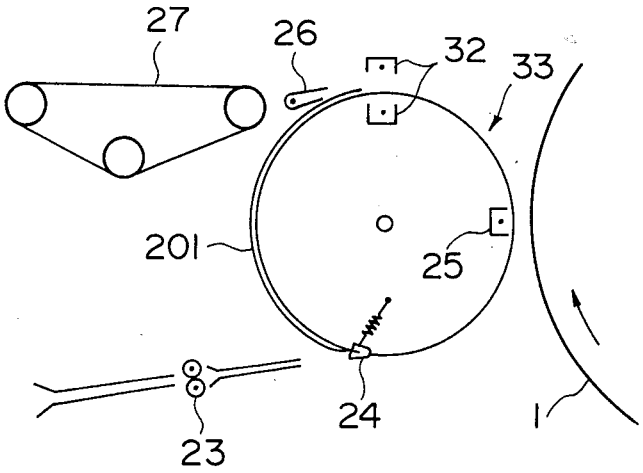
FIG. 2 is a schematic cross-section of the transfer drum and associated parts shown in FIG. 1.

As seen from FIG. 2, the transfer drum 33 is in the form of a cylinder which is partially apertured to form an opening. This opening is covered by a screen member having the same radius of curvature as that of the cylinder and being used as a transfer sheet supporting member. The cylinder portion having no opening includes a plurality of said grippers 24 which are mounted thereon and arranged along the generating line of the cylinder. The above screen member may be of a dielectric mesh screen type which is made of polyester, polyethylene or the like. As shown in FIG. 2, the transfer sheet 201 is grasped at its leading edge by the grippers 24 and held into intimate contact with the outer periphery of the transfer drum 33 under the electrostatic attraction relative to the dielectric mesh screen. This electrostatic attraction is created under the action of the transfer corona charger 25.

After completion of the transfer process, the transfer sheet is separated from the transfer drum 33 by charge-removing the transfer sheet under the action of a charge removing devices (corona dischargers) 32 before the transfer sheet reaches opposite to the separation pawl 26. The charge removing devices 32 are positioned inside and outside of the transfer drum opposed to each other. In such a manner, the electrostatic attraction between the transfer sheet and the screen is relieved so that the transfer sheet will easily and gently be released from the transfer drum as the leading edge of the transfer sheet is moved in the predetermined direction.

The dielectric mesh screen structure of the transfer drum is used for the purpose that the transfer sheet can effectively be subjected to the corona discharger. However, the mesh screen may be replaced by a thin-walled dielectric plate which does not interfere with the function of the corona discharger and has a strength sufficient to support the transfer sheet.

The charge removing action may reduce the attraction of the non-fixed toner particles to the transfer sheet. If charge is removed too far from the transfer sheet, the toner particles may be disturbed or scattered on the transfer sheet when the latter is subjected to vibration in the path 27. Accordingly, the charge removing action must be so controlled that the non-fixed toner image on the transfer sheet is not disturbed until the image has been fixed to the transfer sheet.

The charge removing action may be carried out at each completion of the transfer steps in the multitransfer process for the purpose that the efficiency of transfer for each color is maintained at the desired level. This also must properly be controlled to avoid various disadvantages, for example, that the non-fixed toner particles are scattered from the transfer sheet during the movement thereof, that the transfer sheet is deviated from the desired position on the transfer drum under a reduced force for holding the transfer sheet on the mesh screen, resulting in non-registered image, and so on.

The electrostatic attracting by which the non-fixed toner is held on the transfer sheet and the transfer sheet is held on the mesh screen of the transfer drum is highly influenced by the humidity. Therefore, the charge removing action must be controlled in consideration of the humidity.

The present invention uses a charge removing device which can properly be controlled at output, by a humidity sensor mounted in the copying machine, in accordance with the variations of the humidity.

Figure 4:
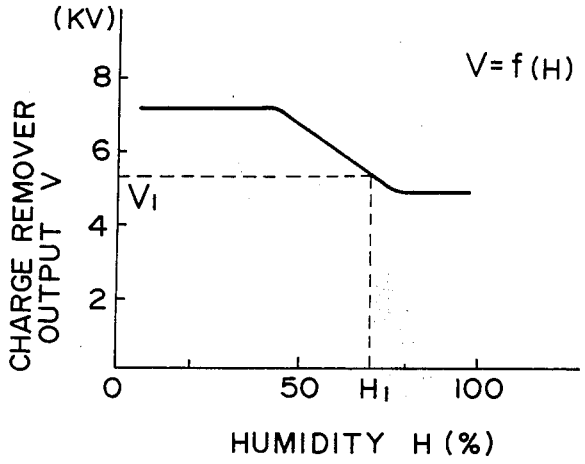
FIG. 4 is a graph illustrating a characteristic curve between the humidity and the charge remover output in the charge removal controlling means shown in FIG. 3.
Figure 3:
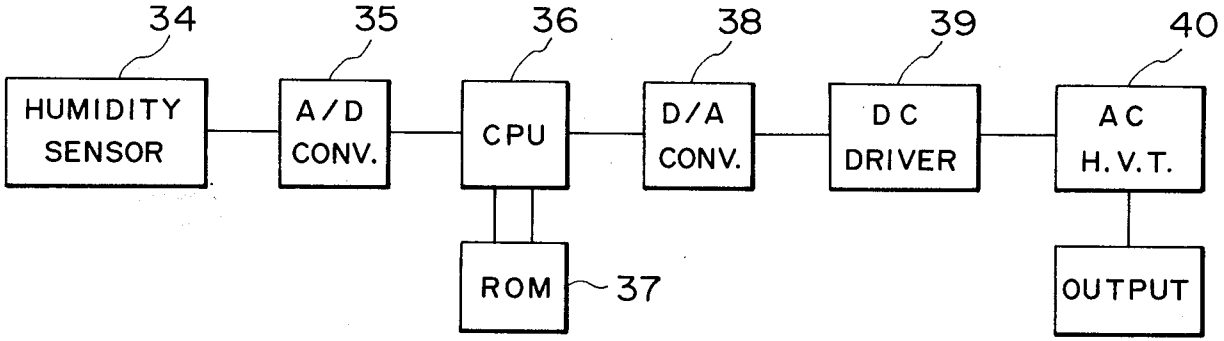
FIG. 3 is a block diagram showing the charge removal controlling means shown in FIG. 1 after a transfer step been completed.

FIG. 3 shows such a charge removing device which comprises an atmospheric humidity sensor 34 mounted within the electrophotographic type copying machine. The humidity sensor 34 may be in the form of a high-molecular humidity sensor which changes its conductivity in accordance with the atmospheric humidity, a ceramic humidity sensor for detecting the variations of the humidity in accordance with the variations of resistance caused by the change of the humidity, and so on. The atmospheric humidity or corresponding humidity conversion resistance sensed by the humidity sensor is converted into a signal by an A/D converter 35. The signal is supplied to a center processing unit (CPU) 36 which in turn selects a proper degree of charge removal that does not result in the above disadvantages, based on the humidity vs. output characteristics of the charge removing device which have been stored in a read only memory (ROM) 37. This is converted to an analog signal by a D/S converter 38, which signal is used to control an AC high-voltage transformer 40 through a DC driver 39. As a result, the output of the charge removing device 32, that is, the degree of charge removal can be controlled. For example, FIG. 4 shows a curve $V=f(H)$ representing the humidity-output characteristics of the charge removing device where H is the atmospheric humidity and V is an optimum voltage applied to the charge removing device 32 when a transfer sheet is separated from the transfer drum under the variations of humidity. This curve is stored in the ROM 37. If, for example, an atmospheric humidity detected by the humidity sensor 34 is H1, the corresponding optimum voltage V1 for the charge removing device can be obtained from the curve. This durve may experimetally be determined under the condition that the transfer sheet is easily separated without disturbing the toner image.

Figure 5:
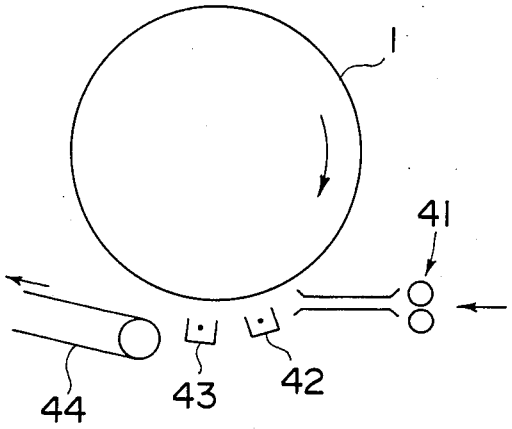
FIG. 5 is a schematic cross-section of another electrophotographic type copying machine to which the principle of the present invention is applied.

Although the electrophotographic type copying machine utilizing the transfer drum has been described, another electrophotographic type copying machine having no transfer drum will now be described with reference to FIG. 5. In FIG. 5, a toner-developed image formed on a photosensitive drum 1 in accordance with the known process is transferred by a transfer charger 24 to a transfer sheet which has been fed toward the photosensitive drum 1 by feed rollers 41. The transfer charger 42 produces a corona discharge having a polarity opposite to that of the toner so that the toner particles on the photosensitive drum 1 will be attracted to the transfer sheet. At this time, there is produced an electrostatic attraction between the photosensitive drum 1 and the transfer sheet due to the charge on the transfer sheet. After completion of the transfer step, the transfer sheet is subjected to the action of a charge removing corona discharger 43 to neutralize the charge on the transfer sheet so that the transfer sheet will easily be separated from the photosensitive drum 1 and moved onto a conveying belt 44. This charge removing corona discharger 43 can automatically be controlled by the use of the same means as in the previous embodiment such that the corona discharger 43 will produce an optimum output under the variations of the humidity. Thus, the transfer sheet can surely be separated from the drum without damage of the quality of image.

Figure 6:
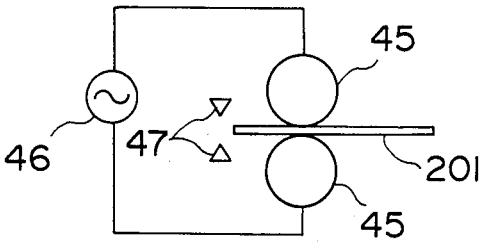
FIG. 6 is a schematic view showing still another means for detecting the moisture content in the transfer sheet in accordance with the present invention.

Although the control of charge removing voltage is carried out by humidity detection means for detecting the atmospheric humidity after completion of the transfer step in the previously described embodiments, this detecting means may be replaced by another humidity detection means for sensing the moisture content in the transfer sheet itself as shown in FIG. 6. The moisture sensing means of FIG. 6 includes electrically conductive rollers 45 located in the path of transfer sheets which are fed to the transfer drum shown in FIGS. 1 and 2 or to the transfer charger station shown in FIG. 5. Only when a transfer sheet 201 between these electrically conductive rollers 45 is detected by a position sensor 47, an electric current is supplied to the rollers 45 from a source of current 46. Since the electric resistance of the transfer sheet is reduced depending on the increased moisture content therein, the moisture content can be determined by detecting the variations of the resistance of the transfer sheet.

The present invention is applicable not only to electrophotographic apparatuses but also to electrostatic printing apparatuses and to magnetic printing apparatuses, if the transfer material or sheet is subjected to the charge removing operation after the image is transferred thereto.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable member for bearing an image;

means for forming a latent image on said image bearing member;

means for developing the latent image with toner to form a toner image;

means for electrostatically transferring the toner image onto a recording material;

charge removing means, disposed opposed to said image bearing member and downstream of said transferring means with respect to movement of said image bearing member, for removing the electric charge given to the recording material upon operation of said transferring means to separate said recording material from said image bearing member;

humidity detection means for detecting humidity; and means for controlling said charge removing means in accordance with an output of said humidity detection means.

2. An image forming apparatus as defined in claim 1 wherein said humidity detection means detects the atmospheric humidity around said transfer sheet.

3. An image forming apparatus as defined in claim 1 wherein said humidity detection means detects the moisture content in said transfer sheet.

4. An apparatus according to claim 1, wherein said charge removing means is effective to remove the charge to such an extent that toner can be supported on the recording material.

5. An image forming apparatus, comprising:

a rotatable member for bearing an image;

means for forming latent images for different color components on said image bearing member;

a plurality of developing means for developing the latent images with toner developers having different colors corresponding to the color components;

a transfer charger for transferring the developed images onto a recording material repeatedly;

movable means for supporting the recording material to feed the same recording material to said transfer charger repeatedly;

charge removing means, disposed opposed to said supporting means and downstream of said transferring means with respect to movement of said movable means, for removing the electric charge given to the recording material upon operation of said transferring means;

humidity detection means for detecting humidity; and means for controlling said charge removing means in accordance with an output of said humidity detection means.

6. An apparatus according to claim 5, wherein said charge removing means is effective to remove the charge to such an extent that the toner can be supported on the recording material.

7. An apparatus according to claim 5, wherein said charge removing means decreases its charge removing power when high humidity is detected by said humidity detection means.

* * * * *

UNITED STATES PATENT AND TRADEMARK OFFICE

CERTIFICATE OF CORRECTION

PATENT NO. : 4,676,627

DATED : June 30, 1987

INVENTOR(S) : Akio Ohno

It is certified that error appears in the above-identified patent and that said Letters Patent is hereby corrected as shown below:

Title page:

IN THE REFERENCES [56] U.S. PATENT DOCUMENTS

"3,575,502 4/1981 Eppe ." should read
--3,575,502 4/1971 Eppe .--.

COLUMN 1

Line 22, "prede-" should read --a prede---.
Line 26, "of" should read --and--.
Line 59, "above mentioined" should read
--above mentioned--.

COLUMN 3

Line 19, "mirror" should read --mirrors--.
LIne 26, "dust-proof" should read --dustproof--.
Line 37, "an whole" should read --a whole--.

COLUMN 4

Line 40, "a" should be deleted.

UNITED STATES PATENT AND TRADEMARK OFFICE

CERTIFICATE OF CORRECTION

PATENT NO. : 4,676,627

DATED : June 30, 1987

INVENTOR(S) : Akio Ohno

It is certified that error appears in the above-identified patent and that said Letters Patent is hereby corrected as shown below:

COLUMN 5

Line 31, "center" should read --central--.
Line 35, "read only" should read --read-only--.
Line 51, "durve" should read --curve--.
Line 52, "metally" should read --mentally--.
Line 62, "24" should read --42--.

Signed and Sealed this

Twenty-first Day of March, 1989

*Attest:*

DONALD J. QUIGG

*Attesting Officer*

*Commissioner of Patents and Trademarks*